United States Patent [19]

Loftin

[11] 4,171,709

[45] Oct. 23, 1979

[54] DEVICE FOR SIPHONING WATER FROM A PONDING AREA ON A FLAT ROOF

[76] Inventor: Douglas W. Loftin, 15 Warren Dr., Little Rock, Ark. 72209

[21] Appl. No.: 922,154

[22] Filed: Jul. 5, 1978

Related U.S. Application Data

[63] Continuation-in-part of Ser. No. 841,601, Oct. 12, 1977.

[51] Int. Cl.[2] ..... F04F 10/02

[52] U.S. Cl. ..... 137/128; 52/16; 137/140; 137/142; 137/357

[58] Field of Search ..... 137/1, 128, 140, 142, 137/357; 52/16

[56] References Cited

U.S. PATENT DOCUMENTS

| | | | |
|---|---|---|---|
| Re. 28,491 | 7/1975 | Kundert | 137/142 |
| 831,817 | 9/1906 | Ackley . | |
| 929,250 | 7/1909 | Reynolds | 137/140 X |
| 2,307,324 | 1/1943 | Larson | 137/357 X |
| 2,313,855 | 3/1943 | Wiggins . | |
| 3,757,812 | 9/1973 | Duncan | 137/142 |
| 4,059,126 | 11/1977 | Nickerson | 137/142 |

*Primary Examiner*—Gerald A. Michalsky

*Attorney, Agent, or Firm*—Cushman, Darby & Cushman

[57] ABSTRACT

An apparatus for removing water from a ponding area of a flat roof having a run-off system which is no longer operable to drain water from the ponding area which comprises a structure for directing a quantity of the run-off water flowing in the run-off system as a result of the commencement of a rain condition or the like into a priming chamber, a structure for displacing water from the priming chamber back into the run-off system in such a way as to establish a negative pressure condition within the priming chamber, and a structure for communicating the negative pressure condition to an end of a siphon hose at a vertical level below the level of the ponding area, the other inlet end of which is disposed in water sucking relation to the ponding area to thereby prime the siphon hose and commence the flow of water from the ponding area which flow after the cessation of the rain condition or the like continues until the water is substantially removed from the ponding area.

15 Claims, 8 Drawing Figures

DEVICE FOR SIPHONING WATER FROM A PONDING AREA ON A FLAT ROOF

This application constitutes a continuation-in-part of my eariler co-pending application, Ser. No. 841,601, filed Oct. 12, 1977, entitled "Method and Device for Siphoning Water from a Ponding Area on a Flat Roof".

This invention relates to the handling of water on flat roofs, and more particularly to an improved device for siphoning water from a ponding area on a flat roof.

While a pitched roof is the construction usually adopted in relatively small building constructions, such as dwellings and the like, flat roof constructions are usually employed in larger buildings where the roof extends over a greater area. Roof constructions of this type are provided with a water run-off system. These systems all provide one or more downspouts or ducts which serve to carry the run-off water from the level of the roof to a level below where it can be disposed of. The downspout in many instances forms a part of a gutter along one peripheral edge of the roof but is more frequently built into the central portion of the roof and extends downwardly alongside of a vertical support or column of the building. In either event, the situation presented is such that the downspout is provided in a position of roof support, either at the exterior wall, as in the case of the gutter construction, or at the column in the case of the interior downspout construction.

Experience has shown that any tendency for flat roof constructions to settle or sag almost invariably results in the creation of areas on the flat roof spaced from the supports and downspouts which are lower than the areas where the roof is supported. These lower areas become ponding areas when a rain condition commences. Once these ponding areas are established, they tend to increase and have a deleterious snowballing effect on the roof. To some extent the weight of the ponding water is added to the roof at a position where the greatest sag occurs. The additional weight causes additional sag, and additional sag increases the size of the ponding areas, etc. Moreover, the existence of standing water on a roof induces thermal stresses which can cause blistering, cracking and leaking which leads to premature roof failure. The reason for this thermal stress is that, after a rain when the sun is again directly shining on the roof, the areas of the roof surrounding the ponding area which are not in contact with the ponding water become quite hot, while the adjacent areas of the roof beneath the peripheral areas of the standing water are in an evaporative cooling condition. Thus, there is established periodically occurring local thermal expansion and contraction which induces stresses which would not otherwise be applied in the absence of the ponding water.

While the above-described ponding problem is well known, the solutions presently practiced are all quite expensive. Among the most expensive solutions is to re-finish the roofing surface so as to level out the low spots which provide the ponding areas. Another effort has been to provide pumps operable to remove ponding water by a pumping action. Examples of prior art of this nature are found in the following U.S. Pat. Nos.: 831,817; 2,313,855; 3,757,812; and U.S. Pat. No. Re. 28,491. In general it can be stated that the available pumping systems are likewise expensive and somewhat costly to operate and maintain. In recent months a solar powered roof drain pump has been made commercially available by B. F. Goodrich (See U.S. Pat. No. 4,059,126). This pump is operated by solar energy and the sun's heat is used to prime the pump. Notwithstanding the efforts to date, there still is a need for an effective solution to the ponding problem which is more economical than the solutions heretofore provided.

An object of the present invention is to fulfill the above-described need. In accordance with the principles of the present invention, this objective is obtained by providing structure capable of utilizing a portion of the run-off water when flowing in the run-off system to prime a siphon device operable to siphon the water from the ponding area and discharge the same into the run-off system.

Preferably the siphon device utilized includes a housing defining a priming chamber therein mounted within the water run-off system at a vertical level below the vertical level of the ponding area of the flat roof and siphon hose means having an inlet end mounted in water sucking relation to the ponding area and an opposite end disposed in operative relation with the priming chamber such that negative pressure conditions within the priming chamber are communicated therewith. When this preferred siphon device is used it is preferable in accordance with the principles of the present invention to direct the portion of the run-off water utilized to prime the siphon device into the priming chamber to establish a predetermined water level therein. The actual priming is accomplished by lowering the water level in the priming chamber by displacing the water therefrom into the run-off system to thereby establish a negative pressure within the priming chamber which is communicated with the siphon hose means causing water from the ponding area to flow past the inlet end through the siphon base means.

In accordance with one embodiment of the present invention, the establishment of a predetermined water level within the priming chamber is accomplished by providing the priming chamber with a water outlet opening in its lower portion of a flow capacity less than the flow capacity of a water inlet opening in the upper end thereof so that when the flow of water in the run-off system increases as a result of the commencement of a rain condition or the like the quantity of water available within the run-off system to be directed into the priming chamber through the inlet opening is greater than the quantity of water which can pass from the chamber through the outlet opening and when the flow of water in the run-off system decreases as a result of the cessation of the rain condition or the like the quantity of water flowing in the run-off system available to be directed into the priming chamber through the inlet opening is less than the quantity of water which can flow out of the priming chamber into the outlet opening. In this way the establishment of the predetermined water level within the priming chamber and the lowering thereof are accomplished automatically in response to the flow conditions within the run-off system.

Specifically, the lowering of the water level within the priming chamber occurs as a result of the substantial lessening of the flow in the water run-off system which in turn is a result of the cessation of the rain condition or the like. With this arrangement, the actual operation of the siphon device to remove water from the ponding area will take place generally at a time following the cessation of the rain condition which, of course, is all that is required to maintain the ponding areas clear of standing water.

In another embodiment of the present invention the siphon device is provided with an inlet opening communicating with its upper end which is controlled by a float valve and the flow of water out of the priming chamber is accomplished by means of an inverted U-shaped tube including a first tubular leg portion having a lower end communicating with the lower portion of the priming chamber, a tubular bight portion disposed in the upper portion of the priming chamber and a second tubular leg portion extending downwardly therefrom outwardly of the priming chamber and having an open lower end discharging into the run-off system at a position below the open lower end of the first tubular leg portion. By utilizing this embodiment the commencement of the flow of water in the run-off system as a result of the commencement of a rain condition or the like initially provides for a portion thereof sufficient to raise the water level within the priming chamber to the vertical level of the tubular bight portion at which time the downward flow of water through the second tubular leg portion establishes a flow of water from the priming chamber to the water run-off system through the inverted U-shaped discharge tube. Once this flow is established and the water level in the priming chamber begins to fall, the negative pressure initially created serves to close the inlet float valve so that the negative pressure created by subsequent water displacement from the priming chamber is communicated to the siphon hose means. Thus, with this embodiment the lowering of the water level occurs as a result of the water level reaching the level of the bight portion of the discharge tube and the priming of the siphon hose will occur soon after the commencement of the rain condition and continue thereafter following the cessation of the rain condition or the like so long as there is water in the ponding area to be removed.

A further object of the present invention is the provision of a siphon device constructed in accordance with the principles enunciated above. The invention also extends to the combination of a device of this type with the flat roof and its water run-off system installed in operative relationship with respect to one another.

These and other objects of the present invention will become more apparent during the course of the following detailed description and appended claims.

The invention may best be understood with reference to the accompanying drawings wherein an illustrative embodiment is shown.

Figure 3:
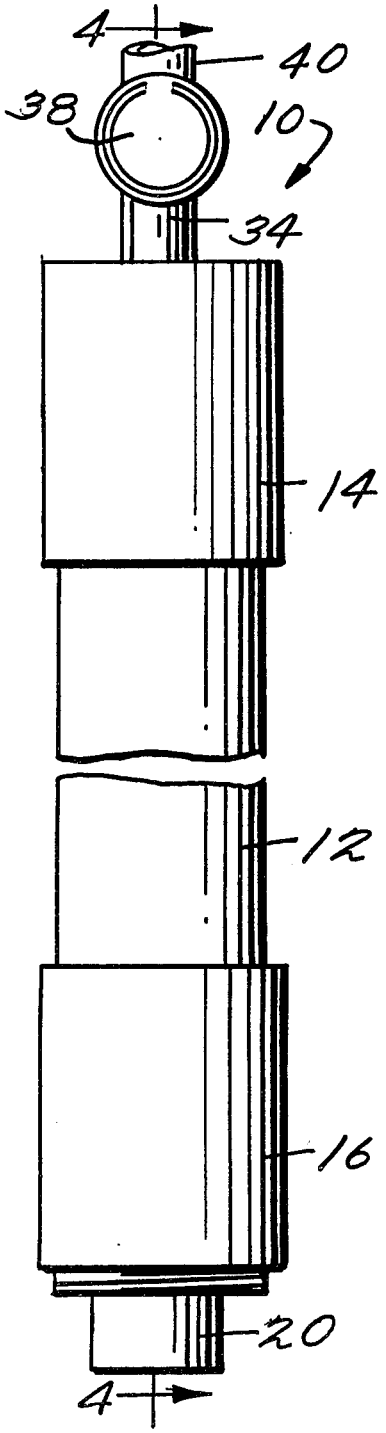
FIG. 3 is a front elevational view of the device of FIGS. 1 and 2 with a portion of the siphon hose cut off.
Figure 4:
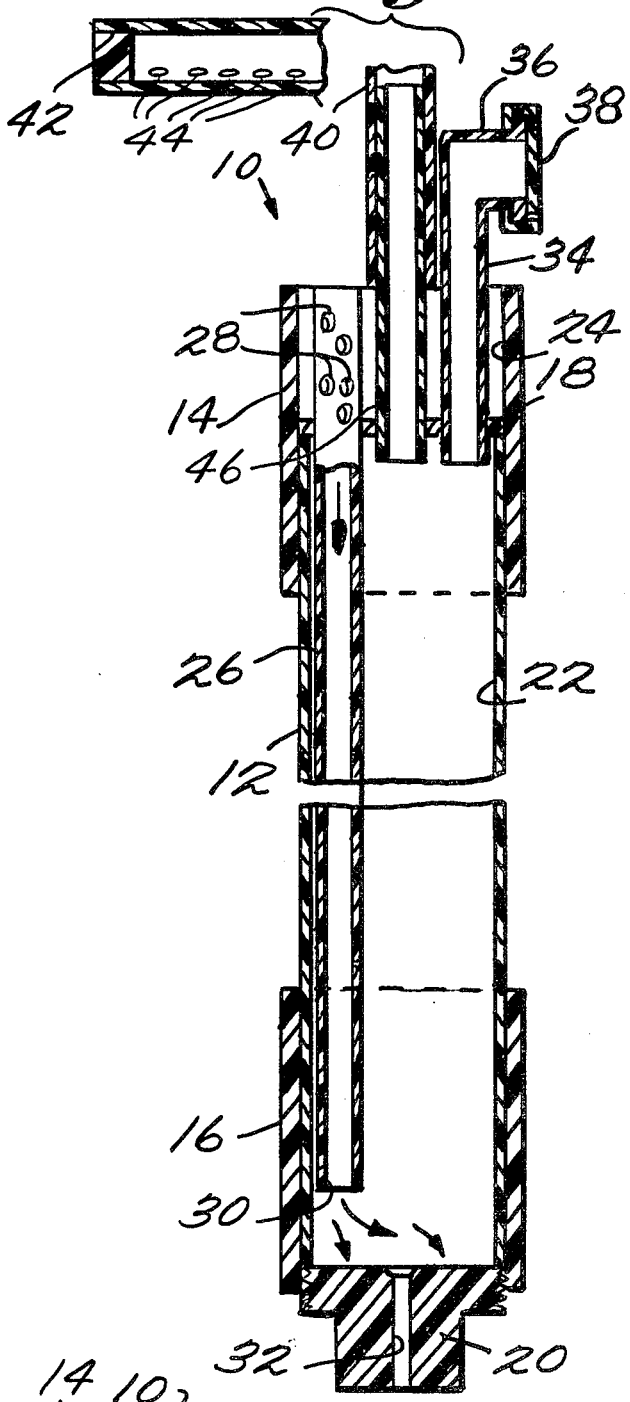
FIG. 4 is a sectional view taken along the line 4—4 of FIG. 3.
Figure 5:
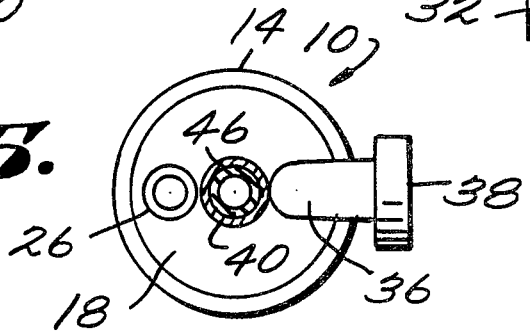
FIG. 5 is a top plan view of the device shown in FIG. 3.

Referring now more particularly to FIGS. 3–5 of the drawings, there is shown therein one embodiment of a device for siphoning water from a ponding area on a flat roof, generally indicated by the numeral 10, which embodies the principles of the present invention. The device 10 includes a tubular housing formed of a central elongated tube 12 having an upper tubular sleeve 14 fixed to the upper end thereof and a lower tubular sleeve 16 fixed to the lower end thereof. As shown, the upper sleeve 14 extends above the upper end of the central tube 12 and has a partition wall 18 fixedly secured therein in exterior peripheral sealing engagement with the central interior periphery of the sleeve and in end edge sealing engagement with the upper end of the central tube 12. The lower sleeve 16 is interiorly peripherally secured to the exterior periphery of the central tube 12 and includes a lower end portion extending below the lower edge of the central tube 12.

Mounted within the lower end of the lower sleeve 16 is an end closure member 20. As shown, the end closure member 20 has an exterior threaded connection with the interior of the lower end of the sleeve 16 and provides an interior engagement with the lower edge of the central tube 12.

The inner periphery of the central tube 12 between the upper partition wall 18 and the lower closure member 20 defines a priming chamber 22. The interior periphery of the portion of the upper sleeve 14 extending above the upper partition wall 18 defines with the upper surface of the latter a run-off water receiving chamber 24 having an open upper end. Inlet opening means is provided between the water receiving chamber 24 and the priming chamber 22. As shown, the inlet opening means is preferably in the form of an inlet tube 26 which is exteriorly peripherally secured in sealing relation with the upper partition wall 18. The inlet tube includes an upper inlet portion extending above the upper partition wall 18 into the water receiving chamber 24, which upper portion is provided with a plurality of inlet openings 28 in the peripheral wall thereof. It will be noted that some of the openings extend through the wall of the inlet tube at the level of the partition wall 18 while some are spaced thereabove. The total cross-sectional area of all of the openings 28 is preferably greater than the cross-sectional area of the inlet tube 26.

It will be noted that the major portion of the inlet tube 26 extends downwardly from the upper partition wall 18 into the priming chamber 22 and has its lower end open as indicated at 30 at a position spaced slightly above the end closure 20. The end closure 20 has an outlet opening 32 extending centrally therethrough, the cross-sectional area of which is less than the cross-sectional area of the inlet tube 26. An exemplary illustration of the size relationship between the inlet opening 30 and outlet opening 32 is one in which both cross-sections are circular with the inlet cross-section having a diameter of approximately ½" while the diameter of the outlet opening 32 is approximately ¼".

The device 10 also includes an air vent tube 34 which is exteriorly peripherally secured in sealing relation with the upper partition wall 18. The vent tube has its lower interior end communicating with the upper end portion of the priming chamber 22 and includes a bent-over upper end portion 36 within which is mounted a check valve assembly 38. The check valve assembly 38 may be of any suitable construction and, as shown, consists essentially of a simple flap valve member which will permit flow of air outwardly from the priming chamber 22 through the vent tube, but will prevent flow of air inwardly into the vent tube.

The device 10 also includes a length of siphon hose 40. As best shown in FIG. 4, a free end of the siphon hose 40 has a plug 42 fixedly secured within the extremity thereof as by cement or the like. Formed along one side of the peripheral wall adjacent the plug 42 is a series of inlet openings 44. The inlet openings 44 are thus positioned so that the free end portion of the hose 40 can be simply rested upon a ponding surface area of the roof, so that when a rain condition occurs the build-up of the water in the ponding area will cover the openings 44.

The opposite end of the hose 40 is fixedly connected in interior communicating relation with the priming chamber 22. Preferably this communication is accomplished by means of a central nipple 46 which has its exterior periphery sealingly secured to the central portion of the upper partition wall 18. The main portion of the nipple 46 extends upwardly above the partition wall 18 and has its exterior periphery adapted to receive the interior periphery of the other end portion of the hose 40. The connection is preferably made secure by means of suitable cement between the exterior periphery of the nipple and the interior periphery of the hose.

It will be understood that the various components of the device 10 described above may be formed of any suitable material. However, a preferred arrangement is to form all of the parts of plastic material.

OPERATION OF DEVICE 10

Figure 1:
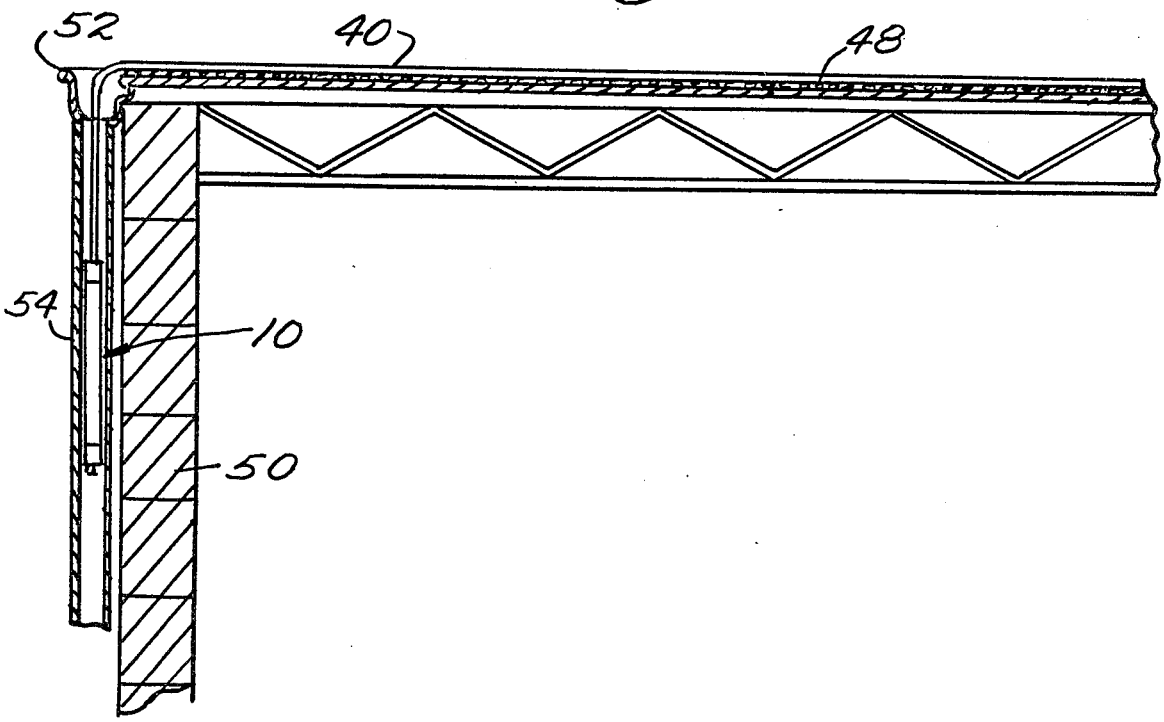
FIG. 1 is a vertical sectional view of a flat roof construction having a side wall gutter and downspout water run-off system showing one embodiment of a device constructed in accordance with the principles of the present invention installed therein.
Figure 2:
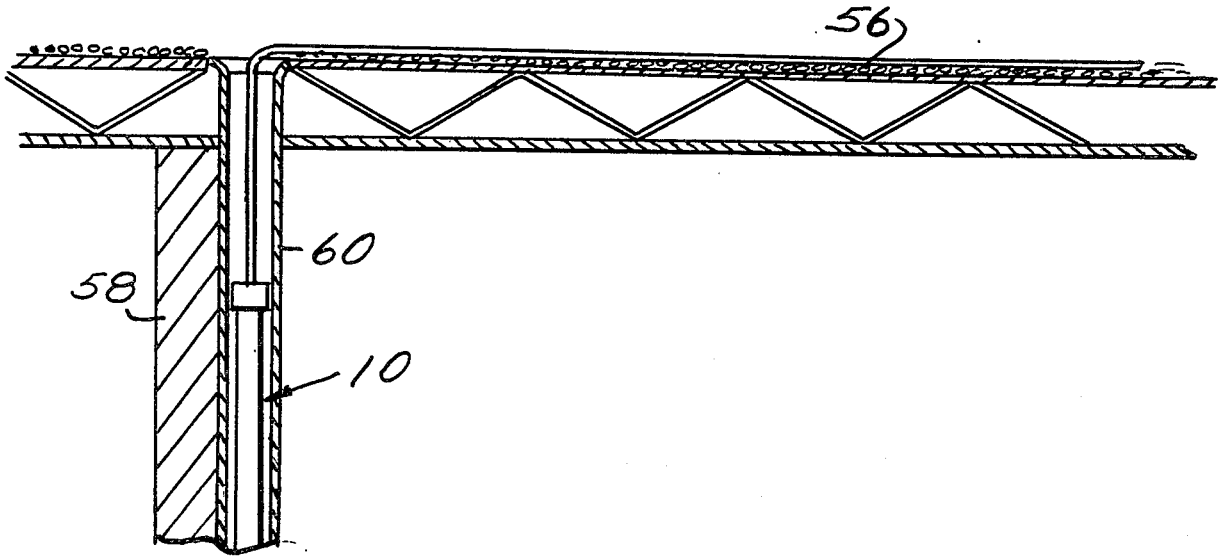
FIG. 2 is a view similar to FIG. 1 of a flat roof construction having a run-off system provided with a central downspout showing the device of FIG. 1 mounted therein.

Referring now more particularly to FIGS. 1 and 2, there are illustrated therein two different flat roof constructions having different types of water run-off systems embodied therein within which the device 10 of the present invention is installed. In FIG. 1 there is shown a flat roof construction, generally indicated at 48, supported at one periphery by an outside wall 50. The water run-off system of the roof construction includes a peripheral side gutter 52 having a downspout 54 extending therefrom.

In FIG. 2 the roof has a flat construction, indicated at 56, with an interior vertical wall 58 supporting the same. Extending downwardly through the central portion of the roof construction 56 adjacent the interior vertical wall 58 is a downspout 60.

In both instances, the device 10 of the present invention is installed in the downspout, such as the downspout 54 or 60 of the embodiments of FIGS. 1 and 2 respectively. The downspout in both instances has a cross-sectional area which is considerably in excess of the cross-sectional area of the device 10. As shown, the mounting of the device 10 within the respective downspout is accomplished simply by lowering the same into the downspout by the hose 40 and allowing the hose to simply suspend the housing in a position disposed below the top of the downspout. The length of the hose is of a weight sufficient to prevent the housing from moving downwardly even when filled with water. However, the hose can be clamped or otherwise secured to insure against its downward movement. The free end of the hose is extended to the middle of the ponding area. The free end is simply positioned of the surface of the ponding area so that the openings 44 face generally downwardly and are in closely spaced relation with the surface of the ponding area without being blocked by the surface. This insures removal of a maximum amount of water from the ponding area.

So long as the ponding area is devoid of water, the device simply remains suspended within the downspout. When a rain condition commences and water is distributed to the flat roof construction, the majority of the water will be directed as run-off water in the run-off system, while a portion of the water will begin to build up as standing water in the ponding area. As the run-off water passes through the downspout, a portion of the water will be caught in the water receiving space 24 and enter the priming chamber 22 through inlet openings 28, inlet tube 26 and the lower inlet opening 30 thereof. As soon as this run-off water is made available to the inlet openings, there is established a rising water level condition with respect to the priming chamber 22.

So long as there is sufficient run-off water in the downspout to maintain the water receiving chamber 24 substantially filled, the amount of water passing into the priming chamber 22 through the inlet openings 28 and 30 will be greater than the amount of water passing out of the priming chamber 22 through the outlet opening 32. Since there is a net intake of water into the priming chamber 22, the water level therein will rise above the opening 30, thus trapping a column of air thereabove within the priming chamber 22 which communicates with the air vent tube 34 and hose 40. Check valve 38 allows this air to be displaced to the atmosphere by liquid displacement as the water level in the priming chamber 22 rises. The water level will rise until it reaches a level adjacent the upper partition wall 18 or, at most, to the upper level of the chamber 24. It will remain at this level so long as there is sufficient water in the run-off system to maintain the water receiving chamber 24 filled.

When the cessation of the rain condition occurs, the amount of run-off water passing through the downspout of the run-off system will decrease to an extent such that water receiving chamber 24 is no longer maintained in a filled condition so that the amount of water flowing through the outlet 32 will exceed the amount of water flowing through the inlet openings 28 from the water receiving chamber 24. When this occurs, there is established a lowering water level condition with respect to the priming chamber 22.

As the water level in the priming chamber 22 is lowered, liquid displacement occurs, which tends to increase the air space thereabove. This liquid displacement creates a negative pressure in the air above the water level, which negative air pressure is communicated with the interior of the air vent tube 34 and hose 40. Check valve assembly 38 in vent tube 34 prevents this negative pressure from being communicated to atmosphere through the air vent tube 34. Since the openings 44 in the free end of the hose are now covered with water standing in the ponding area, the reduced air pressure communicated with the interior of the hose 40 creates a suction through the openings 44 which causes water in the ponding area to be sucked through the openings and into the hose 40. As soon as sufficient water flows through the openings 44 to fill the interior of the hose to an extent such that there is a flow of water downwardly through the nipple 46 into the priming chamber 22, a siphoning action is established which will continue until all of the water in the ponding area has been sucked through the openings 44 and the siphoning action is discontinued by virtue of the flow of liquid in the hose sucking air through the openings 44.

In this way the device 10 is effective in its normal mode of operation to remove water which may accumulate in ponding areas on the roof immediately following the cessation of a rain condition which would otherwise create the standing water. It will be noted that after the completion of the siphoning action through the hose, any water remaining in the priming chamber 22 will simply run out of the outlet opening 32 so that the device 10 is completely drained of water. This is of significance during winter conditions where there may be intermittent periods of freezing.

Figure 6:
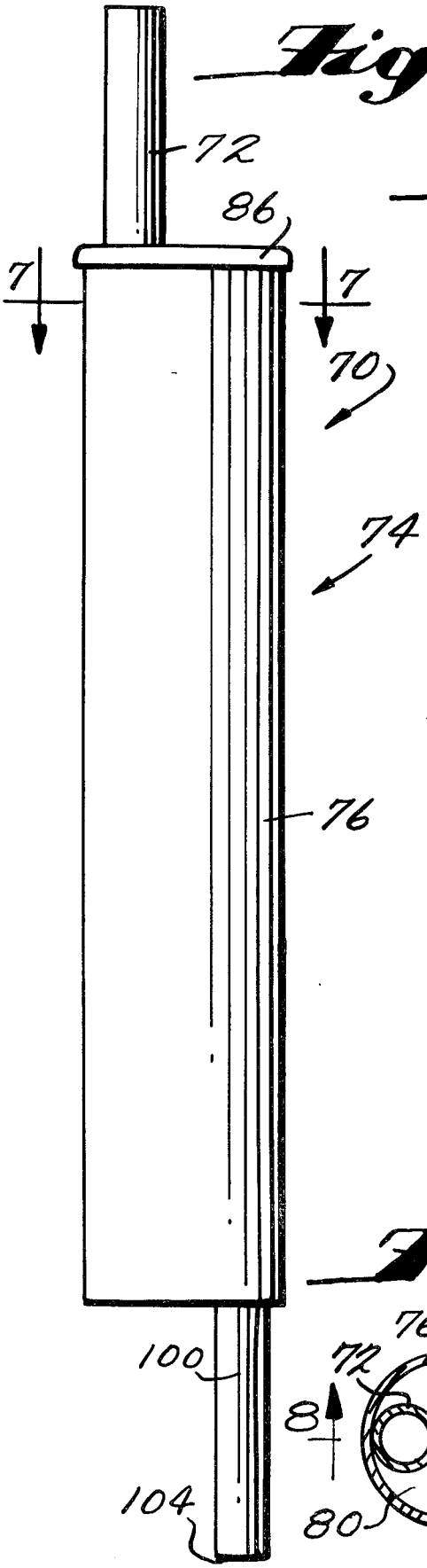
FIG. 6 is a front elevational view of another embodiment of a device constructed in accordance with the principles of the present invention.
Figure 8:
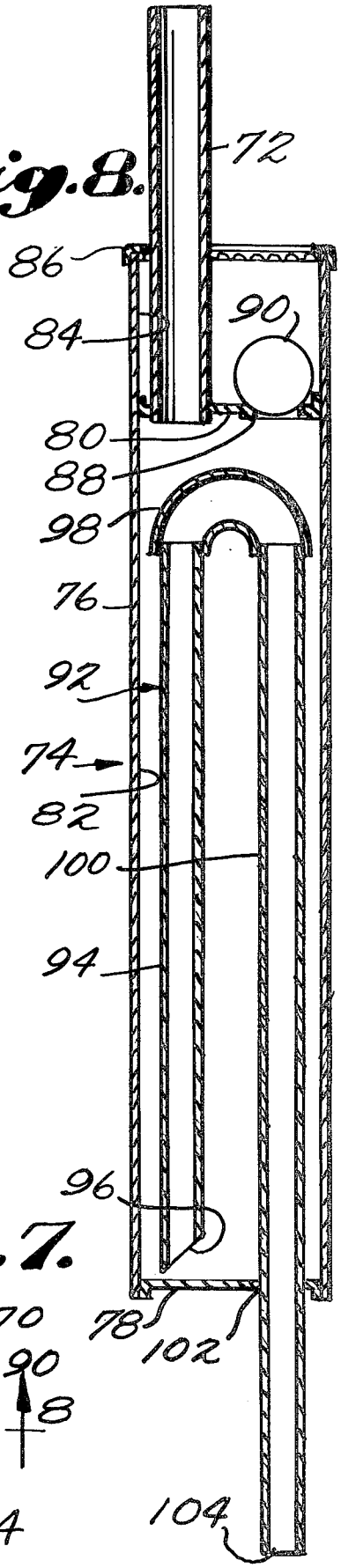
FIG. 8 is a sectional view taken along the line 8—8 of FIG. 7.
Figure 7:
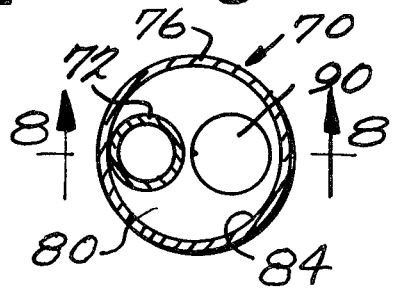
FIG. 7 is a sectional view taken along the line 7—7 of FIG. 6.

Referring now more particularly to FIGS. 6–8, there is shown therein another embodiment of a device, generally indicated at 70, which embodies the principles of the present invention. The device 70 includes a length of siphon hose similar to the siphon hose 40 previously described which is not illustrated in the drawings. As before, the discharge end of the siphon hose is adapted to be connected to a nipple 72 extending upwardly from the upper end of a tubular housing structure, generally indicated at 74, which is similar to the tubular housing of the device 10 previously described. As shown, the tubular housing structure 74 includes a central elongated tube 76 having a lower closure disc member 78 sealingly engaged in the lower end thereof and an upper partition wall 80 sealingly secured to the interior periphery thereof at a position spaced below the upper end thereof.

The inner periphery of the tube 76 between the lower closure member 78 and upper partition wall 80 defines a priming chamber 82 which is similar to the priming chamber 22 previously described in connection with the device 10. As shown, nipple 72 extends through and is exteriorly peripherally sealed with respect to the upper partition wall 80 so that its lower end, which constitutes the lower end of the siphon hose means leading to the ponding area, is disposed in an operative relationship with respect to the priming chamber 82 such that negative pressure conditions within the priming chamber are communicated therewith. Thus, the nipple 72 functions in a manner similar to the nipple 46 previously described.

The interior periphery of the main tube 76 disposed above the upper partition wall 80 defines with the latter a water receiving chamber 84 which is similar to the water receiving chamber 24 previously described. Preferably, the open upper end of the chamber 84 has a screen assembly 86 mounted thereover which serves to permit the passage of water downwardly therethrough into the chamber 84 while preventing debris from entering the same.

The upper partition wall 80 is formed with an inlet opening 88 which serves to communicate the water receiving chamber 84 with the priming chamber 82. A float valve in the form of a table tennis ball 90 or the like is mounted within the water receiving chamber 84. As shown, the floating ball valve 90 is of a diameter size in excess of the diameter size of the inlet opening 88 so that when seated in the annular surface defining the opening 88 the ball 90 will prevent flow of fluid from the chamber 84 to the chamber 82 in response to the establishment of a differential pressure between the two chambers as when the pressure within the priming chamber 82 is a negative pressure.

The operation of the ball valve 90 is such that when pressure conditions other than the negative pressure condition previously described exist with respect to chamber 84 and 82 and water is directed into the chamber 84, such water will cause the float ball valve 90 to move upwardly with a buoyant action away from the annular surface defining the opening 88 and thus permit passage of water from the chamber 84 into the chamber 82. It will be understood that a similar float ball valve arrangement could be utilized in the device 10 for effecting the direction of water flowing in the run-off system into the priming chamber 22 if desired.

In order to discharge water from the priming chamber 82 there is provided an inverted U-shaped tubular discharge structure, generally indicated at 92. This structure includes a first tubular leg portion 94 having its open lower end provided with an angular surface, as indicated at 96, disposed in the lower portion of the chamber 82 in a position adjacent the lower closure member 78. The upper end of the first leg portion 94 communicates with one end of a tubular bight portion 98 disposed within the upper portion of the priming chamber 82. The opposite end of the tubular bight portion 98 is connected with a second tubular leg portion 100 which extends downwardly therefrom in parallel relation to the first tubular leg portion beyond the end 96 thereof and outwardly of the priming chamber 82 through the lower closure member 78 thereof. As shown, the exterior periphery of the tubular leg portion 100 is fixedly sealingly engaged with the closure member 78 as indicated at 102 which connection serves to retain the inverted U-shaped tubular structure 92 in its operative position within the priming chamber 82 as aforesaid. The lower end of the tubular leg portion 100 is open as indicated at 104 so as to discharge into the run-off system within which the housing is mounted. The open end 104 is disposed below the open lower end 96 of the tubular portion 94. The inverted U-shaped tubular structure 92 thus constitutes a siphon for effecting the discharge of water from the priming chamber 82 into the run-off system.

OPERATION OF DEVICE 70

As previously indicated, the device 70 includes in addition to the housing structure 74 a siphon hose similar to the siphon hose 40 of the device 10 previously described. Moreover, the tubular housing structure 74 is mounted in the downspout of the run-off system of the flat roof construction in a manner similar to that previously described and shown in either FIG. 1 or 2. It will be understood that with the housing structure 74 mounted within the downspout of the run-off system, the open top of the water receiving chamber 84 will be disposed in a position to receive a portion of any water flowing in the downspout of the run-off system as when a rain condition or the like is commenced. As this water enters the chamber 84 it tends to collect on the upper surface of the upper partition wall 80 and as the level of this water rises float ball valve 90 will be buoyantly moved upwardly out of engagement with the annular surface defining the inlet opening 88. This upward floating movement of the ball float valve 90 allows the water within the chamber 84 to pass therefrom through the opening 88 into the priming chamber 82. As a portion of the water flowing in the run-off system is directed into the chamber 84 and flows past the inlet opening 88 into the priming chamber 82, the water level in the lower portion of the priming chamber 82 will rise.

Initially, the flow of water into the priming chamber 82 displaces air outwardly through the discharge structure 92 until the level rises above the lower open end 96 thereof. Thereafter, displaced air passes outwardly of the priming chamber 82 upwardly through the inlet opening either simultaneously with the downward movement of water therethrough or with an intermittent action similar to a gurgling action.

As the aforesaid water flow conditions continue, the water level also rises simultaneously within the first tubular leg portion 94 of the converted U-shaped discharge tube structure 92. When the upper portion of the priming chamber 82 in which the tubular bight portion 98 is mounted is reached, water will begin to flow through the bight portion 98 and into the second tubular leg portion 100. As this water passes through the leg portion 100 toward the outlet 104, a siphon effect is established which tends to maintain movement of water upwardly through the first tubular leg portion 94 from the water contained in the priming chamber 82. Thus, once the predetermined level of the tubular bight portion 98 is reached, and the water begins to flow out of the inverted U-shaped structure 92, the latter will through the siphoning action thus started continue to displace water from the priming chamber 92.

The size of the discharge structure 92 is such as to displace a quantity of water which is greater than that which can pass into the priming chamber 82 through the inlet opening 88. In this way, the water displacement establishes within the priming chamber 82 a negative pressure which causes water in the lower portion of the chamber 84 maintaining float valve 90 above the inlet opening 80 to be sucked into the chamber 82 along with the ball valve 90. Consequently, the initial effect of establishing the negative pressure conditions within the upper portion of the priming chamber 82 by virtue of the displacement of water therefrom to the run-off system through the discharge tube structure 92 is to cause the ball valve 90 to move into closing relationship with the inlet opening 88. Once ball valve 90 is engaged with the seat defining the inlet opening 88, the nipple 72 and the siphon hose connected therewith provide the only other path of communication to the atmosphere for the negative pressure established within the priming chamber 82. Consequently, as the water from the priming chamber continues to be discharged through the end 104 of the discharge tube structure 92 and the water is displaced thereby from the priming chamber 82, the negative pressure thus created is transmitted through the nipple 72 and siphon hose to the inlet thereof, thus causing water communicating with the inlet to move past the inlet of the siphon hose through the siphon hose past the nipple 72 and into the priming chamber 82. Once this flow is established, the siphon hose to the ponding area is primed and the siphoning action will continue so long as there is water in the ponding area to be removed.

The capacity of the siphon hose and nipple 72 in terms of the rate of flow of water into the priming chamber 82 is preferably greater than the capacity of flow provided by the discharge tube structure 92. With this arrangement, once the priming action has taken place and there is flow of water from the ponding area through the nipple 72 into the priming chamber 82, the flow of water into the priming chamber will exceed that flowing out of the chamber through the discharge tube structure 92. Under these circumstances, the water level in the chamber 82 will rise above the predetermined level of the tubular bight portion 92 upwardly through the inlet opening 88 causing the ball valve 90 to move upwardly away from the surface defining the inlet opening 88 through a buoyant action. The water level will continue to rise until it overflows upwardly through the screen assembly 86 and pours over the outer tube 76 of the housing structure 74 into the run-off system. In this way, the screening assembly 86 is backflushed to insure that any debris accumulating on the upper surface thereof will be washed off and flow into the run-off system. Screen assembly 86 also serves to keep the ball valve 90 from passing out of the chamber 84.

It can thus be seen that the operation of the device 70 is such that the priming of the siphon hose which serves to remove the water from the ponding area takes place as soon as sufficient water has entered the priming chamber 82 to reach the tubular bight portion 98 and effect a flow of water downwardly through the tubular leg portion 100 and out of the end 104. With this arrangement the siphoning action from the ponding area will continue throughout the existence of the rain condition and after the rain condition has stopped the action will continue so long as there is water in the ponding area to be removed.

The operation of the inverted U-shaped discharge tube structure 92 is such that water will continue to flow therethrough so long as there is water contained within the priming chamber 82 at a level above the lower open end 96. Moreover, the momentum of the flow is such that it will tend to suck up water in the bottom of the chamber 82 even after the level has dipped below the upper angular end at 96. Consequently, when the flow in discharge pipe structure 92 is finally completed, there will be a small amount of water left in the bottom of the priming chamber 82, however, this small amount of water is insufficient to fully cover the open end 96.

The device 70 is preferable for the reason that its operation enables the utilization of lengths of siphon hose which have an internal volume in excess of the internal volume of the priming chamber 82. Where this condition exists, the device 70 is still operable to effect a priming of the siphon hose in the following manner. The initial filling of the priming chamber 82 takes place in a manner previously indicated through the inlet opening 88 until the predetermined level is reached, at which time flow through the inverted U-shaped discharge tube structure 92 is commenced. The initial displacement of water from the upper end of the priming chamber 82 by the flow of water outwardly therefrom will close valve 90 as aforesaid and the subsequent negative pressure generated by the lowering of the water level in the priming chamber 82 will serve to move water into the siphon hose. In the event that the priming chamber 82 is exhausted of water before the siphon hose is primed and a flow therefrom into the priming chamber is commenced, the flow of water outwardly of the end 104 will cease, thus communicating the atmospheric pressure of the run-off system through the emptied tubular structure 92 with the priming chamber 82. As soon as the pressure within the priming chamber 82 rises to atmospheric level, the forces acting to pull ball valve 90 down into engagement with the annular surface defining the inlet 88 are relieved, causing the ball valve to float upwardly and permit water in the receiving chamber 84 to pass through the inlet 88 into the priming chamber 82 to again raise the level therein to the predetermined value necessary to commence flow outwardly through the discharge tubular structure 92. During this action, not all of the water which had previously flowed from the ponding area past the inlet end of the siphon hose will have flowed in the opposite direction outwardly to the ponding area past the inlet end. Consequently, during the next communication of negative pressure, as when the flow of water out of the priming chamber is commenced by the operation of the discharge tube structure 92, there will be already contained with the siphon hose a certain displacement of water depending upon how much has been retained in the last cycle. This action can continue until there is sufficient displacement with the siphon hose to effect full priming and commence the flow into chamber 82.

Another advantage of the utilization of the device 70 is that the flow provided through discharge tubular leg portion 100 may be utilized to prime additional siphon hoses in the manner suggested by the aforesaid U.S. Pat. No. Re. 28,491, the disclosure of which is hereby incorporated by reference into the present specification for that purpose. Moreover, in accordance with the principles of the present invention, two or more additional siphon hose lines may be connected with the tubular leg portion 100 at the same vertical level as by the utilization of a cross-fitting or the like. The flow of water downwardly through the tubular leg portion 100 past the branch openings causes a suction at the branch openings which is communicated with the additional siphon hoses and is operable to prime those siphon hoses which preferably have their inlet ends mounted at different ponding area locations on the flat roof. It will be understood that an arrangement of this type may be utilized in connection with device 10 by simply extending the discharge opening 32 into a discharge tube to which the cross-fitting can be mounted. It will also be understood that the lower closure member 78 of the device 70 may be provided with a leakage hole or passage similar to the passage 32 for the purpose of draining water therefrom and preventing damage by freezing. Under these circumstances, the size of the opening would be substantially less than that embodied in the device 10, although by making the hole size similar to that shown in the device 10, a combination of the two procedures achieved can be secured.

While it is preferred in accordance with the principles of the present invention to utilize water flowing in the run-off system to prime the siphon hose means through a positive displacement of such water from a priming chamber, it will be understood that it is within the contemplation of the present invention to effect such priming by establishing a negative pressure through flow of such water past an orifice as well as by positive displacement thereof.

It thus will be seen that the objects of this invention have been fully and effectively accomplished. It will be realized, however, that the foregoing preferred specific embodiment has been shown and described for the purpose of illustrating the functional and structural principles of this invention, and is subject to change without departure from such principles. Therefore, this invention includes all modifications encompassed within the spirit and scope of the following claims.

What is claimed is:

1. A device for removing water from a ponding area on a flat roof having a water run-off system which is no longer effective to drain water from said ponding area comprising:

a housing defining a priming chamber therein adapted to be mounted within the water run-off system at a vertical level below the vertical level of the ponding area of the flat roof, siphon hose means having an inlet end adapted to be mounted in water sucking relation to the ponding area and an opposite end disposed in operative relation with said priming chamber such that negative pressure conditions within said priming chamber are communicated therewith, and priming means for (1) communicating run-off water flowing in said run-off system with said priming chamber when said housing is mounted therein as aforesaid so as to establish a predetermined water level condition within said priming chamber and (2) lowering said water level condition within said priming chamber by the displacement of water out of said priming chamber into said run-off system to thereby establish a negative pressure within the priming chamber which is communicated with said siphon hose means causing water from the ponding area to flow past the inlet end through the siphon hose means which flow continues by the siphoning action thus established until the water in said ponding area is substantially removed.

2. A device as defined in claim 1 wherein said priming means includes water inlet opening means communicating with said priming chamber adapted to be disposed within the water run-off system in a position to direct run-off water flowing in said run-off system into said priming chamber, and water discharge outlet opening means communicating with said priming chamber of a flow capacity less than the flow capacity of said water inlet opening means so that (1) when the flow of water in said run-off system increases as a result of the commencement of a rain condition or the like the quantity of water available to pass into said priming chamber through said inlet opening means is greater than the quantity of water which can pass from said chamber through said outlet opening means and (2) when the flow of water in said run-off system decreases as a result of the cessation of the rain condition or the like the quantity of water available to pass into said priming chamber through said inlet opening means is less than the quantity of water which can flow out of said priming chamber through said outlet opening means to thereby establish the aforesaid displacement of water out of said priming chamber.

3. A device as defined in claim 2 wherein said housing includes an upper partition wall defining a water receiving chamber above said priming chamber having an open upper end into which water flowing downwardly through a downspout in said run-off system can enter said receiving chamber.

4. A device as defined in claim 3 wherein said inlet opening means comprises an inlet tube exteriorly peripherally secured to said upper partition wall and opening upwardly into said water receiving chamber and downwardly into the lower end portion of said priming chamber.

5. A device as defined in claim 4 wherein said inlet tube includes an inlet portion extending above said upper partition wall, said inlet portion having a plurality of openings extending through the peripheral wall thereof, the total cross-sectional area of said plurality of openings being greater than the interior cross-sectional area of said inlet tube, at least some of said openings being disposed at the vertical level of said upper partition wall and some being spaced thereabove.

6. A device as defined in claim 5 wherein said upper partition wall has an air vent tube exteriorly peripherally secured thereto forming a part of said air displacement means, said vent tube having an upper bent-over end portion and a check valve in said bent-over end portion permitting the flow of air outwardly therethrough but preventing the flow of air inwardly therethrough.

7. A device as defined in claim 4 wherein said upper partition wall includes a tubular nipple exteriorly peripherally secured to the central portion thereof, said siphon hose means including said nipple and a length of flexible hole having one end thereof fixedly secured to the upper end of said nipple in interior communicating relation therewith.

8. A device as defined in claim 1 wherein the inlet end of said siphon hose means is defined by the other end portion of said hose and a plug is mounted in the extremity of said other end portion of said hose, the peripheral wall of said other end portion having an opening in one side thereof adapted to be disposed in sucking relation to water in said ponding area.

9. A device as defined in claim 1 wherein said priming means includes water inlet opening means communicating with said priming chamber adapted to be disposed within the water run-off system in a position to direct run-off water flowing in said run-off system into said priming chamber, a water discharge siphon structure communicating with said priming chamber operable when the water in said priming chamber reaches a predetermined level to displace water from said priming chamber at a rate sufficient to establish a negative pressure condition within said priming chamber, and valve means for closing said water inlet opening means when said negative pressure condition is established so that the communication thereof with said siphon hose means causes the aforesaid flow of water from the ponding area.

10. A device as defined in claim 9 wherein water discharge siphon structure includes a first tubular leg portion having an open lower end communicating with the lower portion of the priming chamber, a tubular bight portion disposed in the upper portion of the priming chamber and a second tubular leg portion extending outwardly of the priming chamber and having an open lower end discharging into the run-off system at a position below the open lower end of the first tubular leg portion.

11. A device as defined in claim 7 or 10 wherein said housing includes an upper partition wall defining a water receiving chamber above said priming chamber having an open upper end into which water flowing downwardly through a downspout in said run-off system can enter said receiving chamber.

12. A device as defined in claim 11 wherein said inlet opening means comprises a circular opening in said upper partition wall communicating upwardly with said water receiving chamber and downwardly with the upper end portion of said priming chamber and said valve means comprises a floatable ball in said water receiving chamber of a diameter size greater than the diameter size of said circular opening.

13. In a combination including a flat roof having a ponding area and a water run-off system which is no longer effective to drain water from said ponding area and a device for removing water from said ponding area, the improvement which comprises said device comprising means defining a priming chamber within the water run-off system at a vertical level below the vertical level of the ponding area of the flat roof, siphon hose means having an inlet end mounted in water sucking relation to the ponding area and an opposite end disposed in operative relation with said priming chamber such that negative pressure conditions within said priming chamber are communicated therewith, and priming means for directing run-off water flowing in said run-off system as a result of the commencement of a rain condition or the like into said priming chamber and displacing water directed into said priming chamber outwardly thereof into said run-off system in such a way as to establish a negative pressure within the priming chamber which is communicated with said siphon hose means causing water from the ponding area to flow past the inlet end through the siphon hose means which flow continues after the cessation of the rain condition or the like by the siphoning action thus established until the water in said ponding area is substantially removed.

14. The improvement as defined in claim 13 wherein said priming means includes water inlet opening means communicating with said priming chamber disposed within the water run-off system in a position to direct run-off water flowing in said run-off system into said priming chamber, and water discharge outlet opening means communicating with said priming chamber of a flow capacity less than the flow capacity of said water inlet opening means so that (1) when the flow of water in said run-off system increases as a result of the commencement of a rain condition or the like the quantity of water available to pass into said priming chamber through said inlet opening means is greater than the quantity of water which can pass from said chamber through said outlet opening means and (2) when the flow of water in said run-off system decreases as a result of the cessation of the rain condition or the like the quantity of water available to pass into said priming chamber through said inlet opening means is less than the quantity of water which can flow out of said priming chamber through said outlet opening means to establish a displacement of water out of said priming chamber and thereby a negative pressure condition sufficient to cause the aforesaid flow of water from said ponding area.

15. The improvement as defined in claim 13 wherein said priming means includes water inlet opening means communicating with said priming chamber disposed within the water run-off system in a position to direct run-off water flowing in said run-off system into said priming chamber, a water discharge siphon structure communicating with said priming chamber operable when the water in said priming chamber reaches a predetermined level to displace water from said priming chamber at a rate sufficient to establish a negative pressure condition within said priming chamber, and valve means for closing said water inlet opening means when said negative pressure condition is established so that the communication thereof with said siphon hose means causes the aforesaid flow of water from the ponding area.

* * * * *